United States Patent [19]

Farris

[11] 4,382,542

[45] May 10, 1983

[54] MAIL SIGNAL APPARATUS

[76] Inventor: James W. Farris, Rte. 7, Box 192, Sparta, Tenn. 38583

[21] Appl. No.: 206,348

[22] Filed: Nov. 13, 1980

[51] Int. Cl.[3] ..... B65D 91/00

[52] U.S. Cl. ..... 232/35

[58] Field of Search ..... 232/34, 35

[56] References Cited

U.S. PATENT DOCUMENTS

| | | | |
|---|---|---|---|
| 815,770 | 3/1906 | Weston et al. | 232/34 |
| 2,609,787 | 9/1952 | Lawson | 232/35 X |
| 3,017,073 | 1/1962 | Piergiovanni | 232/35 |
| 4,154,392 | 5/1979 | Galstad et al. | 232/35 |
| 4,247,039 | 1/1981 | Cornwell, Jr. | 232/35 |

*Primary Examiner*—Robert P. Swiatek

*Attorney, Agent, or Firm*—Luedeka & Neely

[57] ABSTRACT

A signal flap (22) is mounted on the exterior face of a mailbox door using a pair of hinges (24 and 26). The signal flap (22) rotates between first and second positions, and in the second position, indicia (42) is exposed to view indicating the presence of mail. A latch (28) secures the signal flap in the first position, and releases the signal flap to rotate to the second position in response to the opening of the mailbox door.

7 Claims, 3 Drawing Figures

MAIL SIGNAL APPARATUS

FIELD OF THE INVENTION

The present invention relates to the field of mailboxes and particularly relates to devices for signaling the presence of mail within a mailbox.

BACKGROUND AND SUMMARY OF THE INVENTION

Most conventional mailboxes have a flag or other device for signaling to the mailman that the patron has placed mail in the box. However, such boxes usually do not include any type of signaling device to indicate that the mailman has placed mail in the box for the patron. It is bothersome to constantly check the mailbox for mail, especially in rural areas where the mailbox is often located a substantial distance from the patron's residence. Thus, a need has arisen for a simple and inexpensive signaling device for a mailbox to signal the presence of mail.

In accordance with the present invention, a signaling apparatus is disposed on the exterior face of a mailbox door. The door opens in a conventional manner in a rotating downward direction. The signaling apparatus includes a signal flap pivotally mounted on the exterior face of the mailbox door for rotation between first and second positions with indicia on one side of the flap to indicate the presence of mail in a mailbox. In the first position, the flap is disposed flush against the exterior face of the mailbox with the indicia facing the mailbox door and hidden from view. In the second position, the indicia on the signal flap faces away from the exterior face of the mailbox door and is thus exposed to view indicating the presence of mail in the mailbox. Of course, the fact that the flap is in the second position, as opposed to the first position, would alone indicate the presence of mail.

A latch secures the signaling flap in the first position and selectively releases the signal flap in response to the opening of the mailbox door. The signal flap is operable to rotate to the second position in response to the opening of the door. Thus, when the mailman deposits mail in the mailbox, the signal flap will be placed in the second position.

In accordance with a particular embodiment of the present invention, a hinge secures the signal flap to the door and is constructed of at least one piece of adhesive tape secured to the bottom edge of the signal flap and to the exterior face of the mailbox door. The latch is an elongate rod pivotally attached at one end to the exterior face of the door at a position immediately above the signal flap when the flap is disposed in the first position. A weight is attached to the distal end of the elongate rod, and the weight and the rod engage and secure the flap in the first position. When the door is opened, the door moves in a downward and outward direction with respect to the mailbox causing the rod and weight to swing outwardly away from the door to release the signal flap to rotate towards the second position.

BRIEF DESCRIPTION OF THE DRAWINGS

The present invention may best be understood by reference to the following Detailed Description when taken in conjunction with the accompanying Drawings in which.

DETAILED DESCRIPTION

Figure 1:
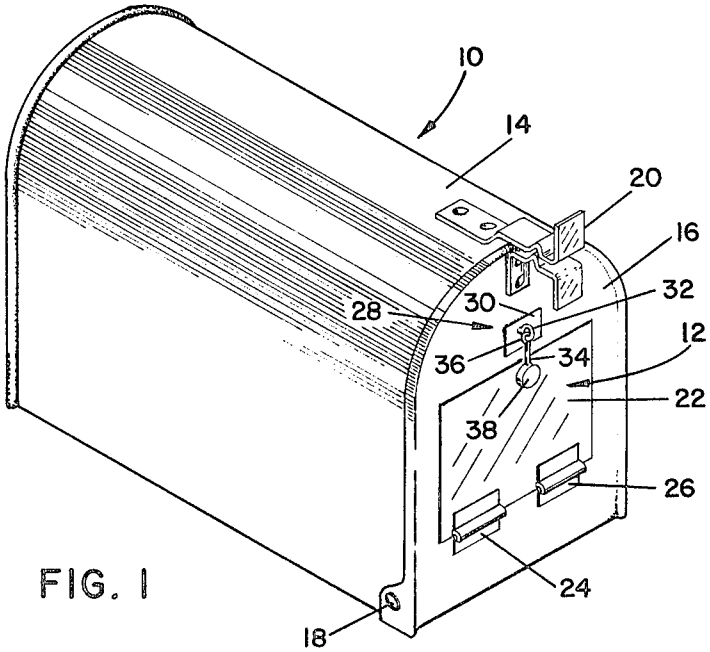
FIG. 1 is a perspective view of a conventional mailbox with the signaling device of the present invention mounted on the mailbox door.

Referring now to the Drawings in which like reference characters designate like or corresponding parts throughout the several views, there is shown in FIG. 1 a mailbox 10 having a signaling apparatus 12 mounted thereon embodying the present invention. The mailbox 10 is conventional in design having a conventional box 14 with a mailbox door 16 mounted thereon. A hinge 18 secures the door 16 to the box 14 so that the door 16 is rotatable about the horizontal axis provided by the hinge 18. To open the mailbox 10, the door 16 is rotated away from the box 14 in an outward and downward direction. The door 16 is held in the closed position as shown in FIG. 1 by a conventional mailbox catch 20.

The signaling apparatus 12 of the present invention includes a signal flap 22. A pair of hinges 24 and 26 secures the signal flap 22 to the exterior face of the mailbox door 16. In the preferred embodiment, the hinges 24 and 26 are adhesively secured to both the mailbox door 16 and the signal flap 22 using conventional adhesives that are available for creating strong adhesive bonds between plastic and plastic, plastic and metal, or metal and metal. The flap 22, the hinges 24 and 26, and the door 16 are preferably constructed of plastic or metal. The hinges 24 and 26 may also simply be strips of high quality weatherproof adhesive tape. In such embodiment, the hinge action is provided by the flexibility of the tape.

The signal flap 22 is held in the upright vertical position shown in FIG. 1 by a latch 28. The latch 28 includes a base 30 that is adhesively bonded to the exterior surface of the door 16. An eyelet 32 is mounted on the base 30 and is oriented in a vertical plane. An elongate rod 34 is attached to the eyelet 32 by an eyelet 36 formed in one end of the rod 34, and a weight 38 is secured to the distal end of the rod 34. The rod 34 and the weight 38 engage the signal flap 22 to secure it in the vertical upright position.

It will be appreciated that the latch 28 may be constructed in numerous different ways. For example, to simplify manufacture, the latch 28 may comprise a strip of tape adhesively secured at one end to the door 16 as is the base 30, and having a weight, such as the weight 38, attached to the other end of the tape.

Figure 2:
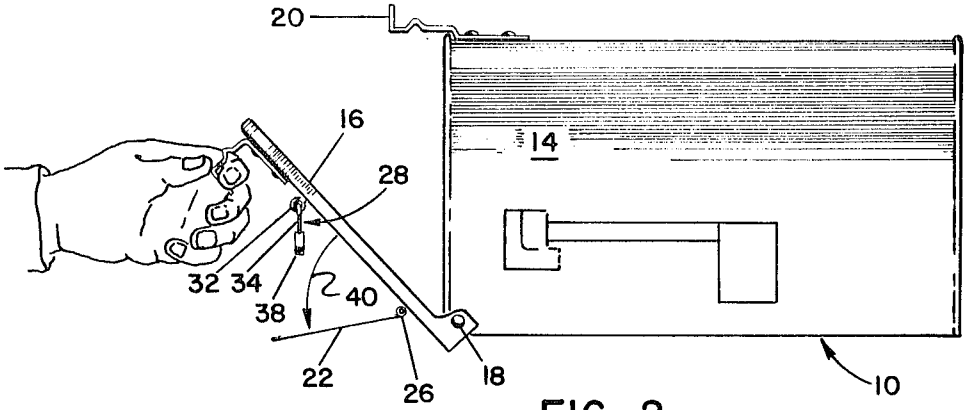
FIG. 2 is a side view of a conventional mailbox showing the mailbox door in a partially opened position with the signaling device of the present invention rotating away from the mailbox door.

Referring now to FIG. 2, there is shown a side view of the mailbox 10 showing the door 16 in a partially open position. It will be appreciated that the door 16 has rotated about the hinge 18 in an outward and downward direction with respect to the box 14. The force of gravity has caused the weight 38 and the rod 34 to swing out away from the door 16. Also, the force of gravity has caused the signal flap 22 to swing away from the door 16. As shown in FIG. 2, the gravity force on the flap 22 has been sufficient to force the weight 38 and rod 34 to rotate outwardly and release the signal flap 22, and the flap 22 is rotating about the hinge 26 under the force of gravity along the path indicated by arrow 40. It will be appreciated that the principal desired characteristic of latch 28 is the function of releasing the flap 22 in response to opening of the door 16.

In this manner, the signal flap 22 will be released from the latch 28 and will fall to a vertical hanging position whenever the mailbox door 16 is open. When mail is placed in the mailbox 10, the signal flap 22 will change positions and indicate the presence of mail. If no mail is delivered or picked up, the door 16 should not have been opened, and the signal flap will not indicate the presence of mail. If the mailman opens the door 16 to remove mail from the box 14, but does not leave any mail, he should cooperate with the patron who owns the box by resetting the flap 22 in the first upright position as shown in FIG. 1.

Figure 3:
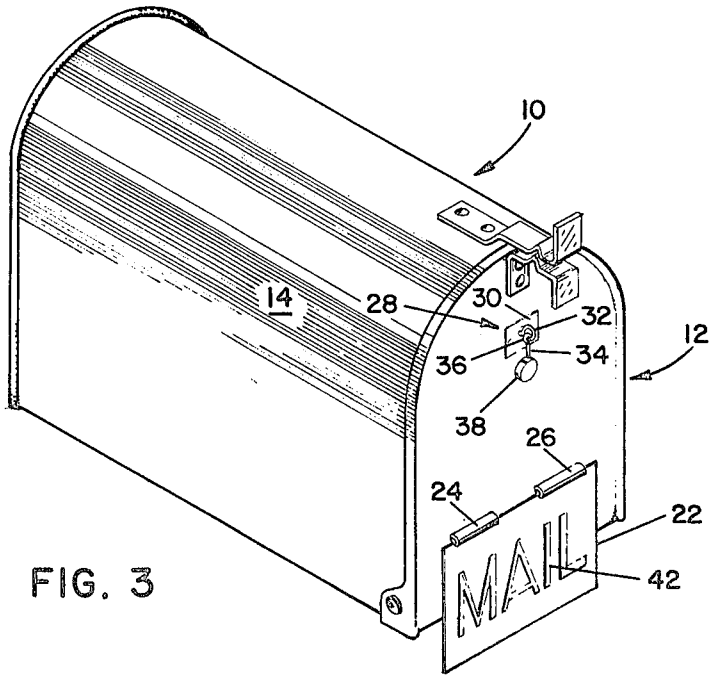
FIG. 3 is a perspective view of a mailbox with the signaling apparatus of the present invention in a position indicating the presence of mail within the mailbox.

Referring now to FIG. 3, there is shown another perspective view of the mailbox 10 showing the signaling apparatus 12 in a position indicating the presence of mail. The signal flap 22 is hanging downwardly from the hinges 24 and 26 in a vertical position. Indicia 42 in the form of the word "MAIL" is exposed to view in this position indicating the presence of mail.

It will also be noted that signal flap 22 in the position shown in FIG. 3 protrudes beneath the bottom of the box 14. Thus, in this position the signal flap 22 is visible from both the front and the rear of the mailbox 10.

When the patron removes his mail from the mailbox 10, the signal flap 22 should be rotated upwardly and resecured by the latch 28 in the vertical upright position. In this manner, other people, such as other family members, responsible for taking mail from the box will note the position of the signal flap 22, and will not make a needless trip to the mailbox. Also, the signal flap 22 is returned to the proper position for indicating on the next day whether the mailman has left mail.

Although a particular embodiment has been described in the foregoing Detailed Description, it will be understood that the invention is capable of numerous rearrangements, modifications, and substitutions of parts without departing from the spirit of the invention.

I claim:

1. A signaling apparatus for being mounted on the exterior face of a mailbox door that opens in a rotating downward direction, comprising:

a signal flap;

attachment means for attaching said signal flap to the exterior face of the mailbox door for movement between first and second positions, said signal flap being disposed in the first position to indicate the absence of mail in the mailbox, said signal flap being disposed in the second position to indicate the presence of mail in the mailbox;

latch means having a movable engagement member disposed at one end adjacent to the exterior face of said door and being configured to engage and hold said signal flap when disposed in the first position for securing said signal flap in the first position, said latch means being operable in response to the opening of the mailbox door to movably disengage said engagement member from said signal flap and release said signal flap to allow it to move to the second position; and said signal flap being operable to move to said second position in response to the opening of said mailbox door.

2. The signaling apparatus of claim 1 further comprising indicia disposed on one side of said signal flap for indicating the presence of mail within a mailbox, said indicia being exposed to view when said signal flap is in the second position and being hidden from view when said signal flap is in the first position.

3. The signaling apparatus of claim 2 wherein said indicia comprises the word "MAIL" imprinted on said signal flap.

4. The signaling apparatus of claim 1 wherein said attachment means comprises at least one hinge mounted on the exterior face of said mailbox door and being attached to the lower edge of said signal flap, so that said signal flap is operable to rotate in response to opening the door about said hinge from said first position to said second position.

5. A signaling apparatus for being mounted on the exterior face of a mailbox door that opens in a rotating downward direction, comprising:

a signal flap;

hinge means for hingedly securing said signal flap to the exterior face of said door for rotation between first and second positions, said signal flap being disposed in an upright vertical position flush against the exterior face of said door in the first position, said signal flap being disposed in a vertical position hanging beneath the hinge means in said second position to indicate the presence of mail in a mailbox;

latch means having an elongate member pivotally attached at one end to the exterior face of said door immediately above said signal flap when disposed in the first position, said elongate member being operable to engage and secure said signal flap in the first position and being further operable in response to opening the mailbox door to swing away from the mailbox door to release said signal flap to rotate towards the second position; and said signal flap being operable to rotate to said second position in response to the opening of said mailbox door.

6. The signaling apparatus of claim 5 further comprising a weight attached to one end of the elongate member for engaging and securing said signal flap in the first position.

7. The signaling means of claim 5 wherein said latch means comprises:

a planar base adhesively secured to the exterior face of said mailbox door immediately above the upper edge of said signaling flap when disposed in the first position;

a first eyelet mounted on said base;

a rod; and a second eyelet formed on one end of said rod and being interconnected with said first eyelet to rotatably secure said rod to said first eyelet, said rod being operable to engage and secure said signal flap in the first position.

* * * * *